US005562230A

United States Patent [19]

Perry

[11] Patent Number: 5,562,230

[45] Date of Patent: Oct. 8, 1996

[54] GREASED END TO ENHANCE COMPOSITE CAN VENTING

[75] Inventor: Michael R. Perry, Plymouth, Minn.

[73] Assignee: The Pillsbury Company, Minneapolis, Minn.

[21] Appl. No.: 456,282

[22] Filed: May 31, 1995

Related U.S. Application Data

[63] Continuation of Ser. No. 118,007, Sep. 8, 1993, abandoned.

[51] Int. Cl.[6] ..... B65D 85/72

[52] U.S. Cl. ..... 220/624; 220/366.1

[58] Field of Search ..... 229/202; 220/366, 220/913, 611, 624, 913, 624, 366, 366.1; 426/118, 128, 395

[56] References Cited

U.S. PATENT DOCUMENTS

| | | | |
|---|---|---|---|
| 3,362,565 | 1/1968 | McCormick | 220/366 |
| 3,858,756 | 1/1975 | Fulton | 426/118 |
| 4,252,268 | 2/1981 | Haire | 220/366 |
| 5,084,284 | 1/1992 | McDilda et al. | 426/128 |
| 5,205,479 | 4/1993 | Rice et al. | 229/202 |
| 5,314,702 | 5/1994 | Lewandowski et al. | 426/395 |

FOREIGN PATENT DOCUMENTS

| | | | |
|---|---|---|---|
| 409731 | 1/1991 | European Pat. Off. | 220/913 |
| 561487 | 9/1993 | European Pat. Off. | 426/128 |

*Primary Examiner*—Stephen J. Castellano
*Attorney, Agent, or Firm*—Janal M. Kalis; Aleya Rahman

[57] ABSTRACT

The present invention includes a lid with a channel for use in sealing a pressurizable can, the lid having a channel for releasing gases generated within the can while substantially preventing the release of liquid from the can. The present invention also includes a method for venting gases from a can having a lid without degrading material stored in the can and substantially preventing the release of liquid from the can. The method includes making a channel in the lid, with the channel traversing the lid.

5 Claims, 3 Drawing Sheets

GREASED END TO ENHANCE COMPOSITE CAN VENTING

This is a continuation of prior application Ser. No. 08/118,007, filed Sep. 8, 1993, now abandoned.

BACKGROUND OF THE INVENTION

The present invention relates to a vented storage container and to a method for venting a container having an internal pressure that is greater than atmospheric pressure.

The storage and preservation of foods such as leavened dough prior to use by a consumer have posed problems because of dynamic properties,of the dough. Some of the problems occur because the dough is a substrate for dynamic chemical reactions that result in an evolution of carbon dioxide gas. The evolution of carbon dioxide gas causes an expansion of the dough, pressurizing the storage container. The rate of pressurization of the container is unpredictable because in part the rate and magnitude of carbon dioxide evolution during storage is dependent upon environmental factors such as temperature that are difficult to control. The rate and magnitude of carbon dioxide evolution are also dependent upon the process time as well as degree of work of the dough and formula of chemical reactants.

Other problems occur during storage of leavened dough because the dough is a substrate for oxidation reactions that undesirably form "grey dough." Gray dough occurs as a consequence of dough being exposed to oxygen for an excessive period of time. In particular, dough acquires a grey color when oxygen in a headspace of a container reacts with dough constituents during storage. It is believed that an oxygen concentration of as little as one to two percent oxygen within the container will result in grey dough.

Containers used to store foods such as leavened dough must be able to accommodate an internal pressure that changes over time and that is greater than atmospheric pressure. These containers should also be able to vent air from the can to prevent the formation of gray dough. Food storage containers that have been used for storing leavened dough have included composite cans. Composite cans include containers made of several layers of material and several types of material.

One type of composite can includes a cylindrical portion made of several material layers and two opposing circular ends attachable to the cylindrical portion to form a sealed can. During storage, the dough and evolved carbon dioxide exert a pressure against the can. The pressure is exerted against the cylindrical portion as well as the circular ends of the composite can.

For one type of composite can, the cylindrical portion includes an outer label layer, a middle paper layer and an impermeable inner liner. The cylindrical portion of one type of composite can also includes a spiral and overlapped seam on the outer label layer and a butt joint on the middle paper layer. The inner liner layer includes a spiral heat seal joint made by folding the inner liner layer back on itself to form an overlapped portion and sealing the overlapped portion.

The label layer is positioned so that the label spans the spiral butt joint of the middle paper layer. The label layer includes an inner surface that faces the middle paper layer and an outer surface. A coating of adhesive applied to the inner surface attaches the label layer to the middle paper layer.

To store a material such as leavened dough within the composite can, a first circular end having an inside surface is attached to one end of the cylindrical composite portion. The inside surface faces the cylindrical portion when installed in the cylindrical portion. The inside surface of the circular end includes an annular lip, a recessed rim adjacent to the annular lip and an annular shoulder adjacent to the recessed rim. The circular end is positioned on a rim of the cylindrical portion so that the rim of the cylindrical portion is positioned within the recessed rim of the circular end. The end is attached to the cylindrical portion by rolling the edge of the end to pinch the cylindrical portion and abutting the annular shoulder of the inside surface of the circular end to the liner of the cylindrical portion. A seamer is typically used to roll the annular lip to the circular end of the cylindrical portion thereby forming a seam.

Once the first circular end is sealed and secured to the cylindrical portion, the leavened dough is placed in the can and typically occupies less than the internal volume enclosed by the can. Volume not occupied by dough is a headspace of the can. The can is then sealed and secured at a second circular end opposing the first circular end, thereby trapping air in the headspace of the can.

The can remains sealed until opened by a user of the dough. The can is opened by the user peeling the label layer along the spiral seam thereby breaching the adhesive bond and weakening the can at the seam to a degree that causes the can to open along the spiral seam and butt joint. This mechanism for opening the can requires the internal pressure of the can to be greater than atmospheric pressure. In some can designs, the user may open a can by similarly removing the label and then pressing at the butt joint of the middle layer with a utensil such as a spoon.

In some composite cans that store dough, gases leak from the space enclosed by the can to the outside of the can in response to the increasing gas pressure from the leavening reactions in the dough enclosed within the can. However, no mechanism is deliberately provided within each can to accommodate or control leakage of the air entrapped in the can headspace. Thus, any leakage of gases from a can does not lend itself to adjustment. If oxygen in air entrapped in the can remains in contact with the dough for an extended period of time, this leads to product deterioration.

Gas leakage in a composite can may occur where the annular shoulder on the inside surface of one of the circular ends abuts the inner liner. In particular, gas leakage is believed to occur at a site where the heat seal joint of the liner faces the annular shoulder of the sealed circular end.

The liner includes a surface that is generally smooth. However, the heat seal joint on the liner layer perturbs the smooth liner surface and creates a site of an uneven thickness. The site may operate as a de facto passage to permit a release of gases from the interior of the can to the exterior of the can. For some composite cans, the heat seal joint creates tiny passages through which headspace gases within the can may pass to the outside of the can.

Because neither the designer of the can nor the manufacturer of the composite can incorporates a specific mechanism for permitting a can to release gases, the gas release of each can becomes haphazard at best. For some cans, the depth of the passage made by the heat seal joint is too shallow to permit a significant venting of gas. For other cans, the passage made by the heat seal joint is restricted when the circular end is sealed to the can. These composite cans release an insufficient quantity of gases. Thus, the consequent variable and inadequate venting causes product deterioration, variable pressures in the can and deterioration of the can.

Openings and passages that are too large allow the escape of gas from the inside of the can but also undesirably allow large quantities of fluids in the dough to contact and permeate the layers of the composite can. The contact deteriorates the can because the fluids can weaken the layers.

SUMMARY OF THE INVENTION

The present invention includes a lid for use in sealing a can under pressure with a channel for releasing gases generated within the can. The present invention also includes a can having a lid with a channel. The present invention also includes a method for venting gases from a can having a lid under pressure without degrading material stored within the can. The method includes making a channel on the lid of the can having dimensions that are effective for venting gases from the can while substantially preventing the release of liquids from the can.

DETAILED DESCRIPTION OF THE PREFERRED EMBODIMENTS

Figure 1:
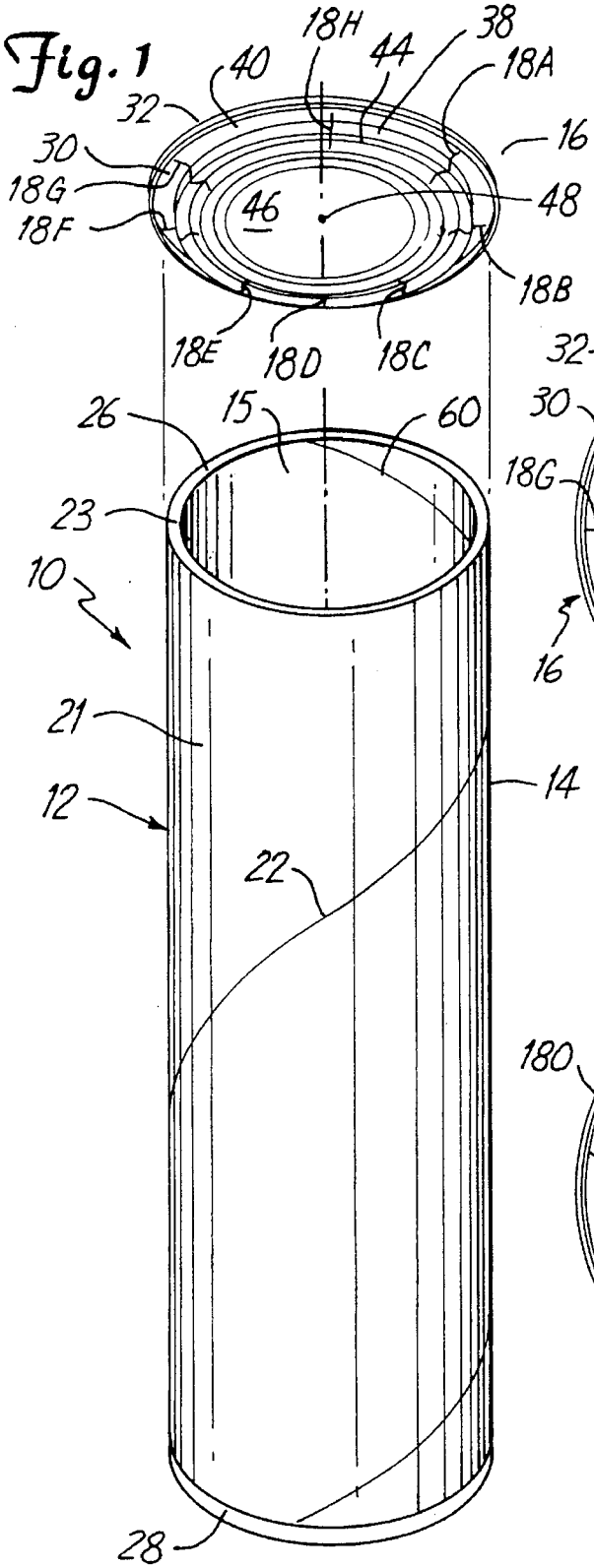
FIG. 1 shows an exploded perspective view of one can embodiment including the lid of the present invention.

The present invention, illustrated generally at 10 in FIG. 1, includes a can 12 having a cylindrical portion 14 and a circular end portion 16 with channels 18A–H for adjustably venting gases within the can 12. The present invention also includes a method for adjustably venting gases from a pressurized can without degrading material stored within the can that includes making a channel in the circular end portion 16 of the can having dimensions effective for venting gases from the can while substanitally preventing a transfer of liquid from material stored in the can to the outside of the can.

The circular end portion 16 with the channels 18A–H provides each can with a mechanism for venting gases at a particular rate. Consequently, the channels 18A–H vent the can 12 in a controlled and a predictable manner. Further, the channels 18A–H of the end portion 16 are sized to substanitally prevent a loss of liquids from the can 12.

In one preferred embodiment, the end portion 16 has a circular symmetry and is made of a metal such as tin plated steel. The circular end portion 16 includes an inner surface 40, illustrated in FIG. 1, that faces the can 10 when installed on the can 10 and an outer surface (not shown) that opposes the inner surface 40.

Figure 2:
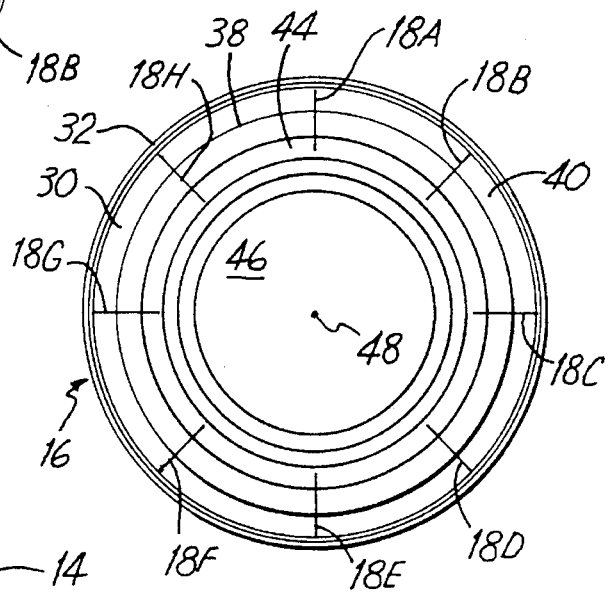
FIG. 2 shows a plan view of an inner surface of the lid having channels of one embodiment of the present invention.
Figure 3:
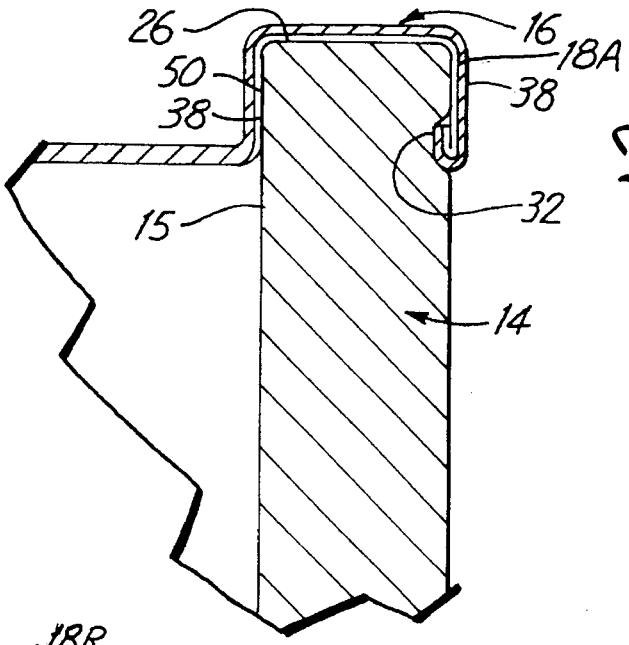
FIG. 3 shows a cross-sectional view of a lid having a channel of the present invention when sealed to a can with a clench seal.

The circular end portion 16 also includes a rim 30 and a precurled lip 32 concentric to the rim 30, such as is illustrated for the inner surface 40 in FIG. 2. The rim 30 receives an upper end 26 of the cylindrical portion 14 when the circular end portion 16 is installed on the cylindrical portion 14. When the end portion 16 is installed on the cylindrical portion 14, the precurled lip 32 is rolled back on itself and clenches the cylindrical portion 14 of the can 10, thereby securing the end portion 16 to the cylindrical portion 14, such as is illustrated in FIG. 3.

The inner surface 40 of the end portion 16 also includes an outer annular shoulder 38 conjoining the rim 30 and an inner annular ridge 44 adjacent to the outer annular shoulder 38 as is shown in FIG. 1. The outer annular shoulder 38 is concentric to the inner annular ridge 44. Preferably, the outer annular shoulder 38 is integral with the inner annular ridge 44. In one embodiment, the outer annular shoulder 38 is tapered to meet the inner annular ridge 44. The outer annular shoulder 38 and the inner annular ridge 44 extend below the rim 30 when the inner surface 40 is oriented to face the can 12.

The inner surface 40 of the end portion 16 also includes a substantially flat circular surface 46 conjoined with the inner annular ridge 44. The flat circular surface 46 includes a center 48 of the circular end portion 16.

Figure 9:
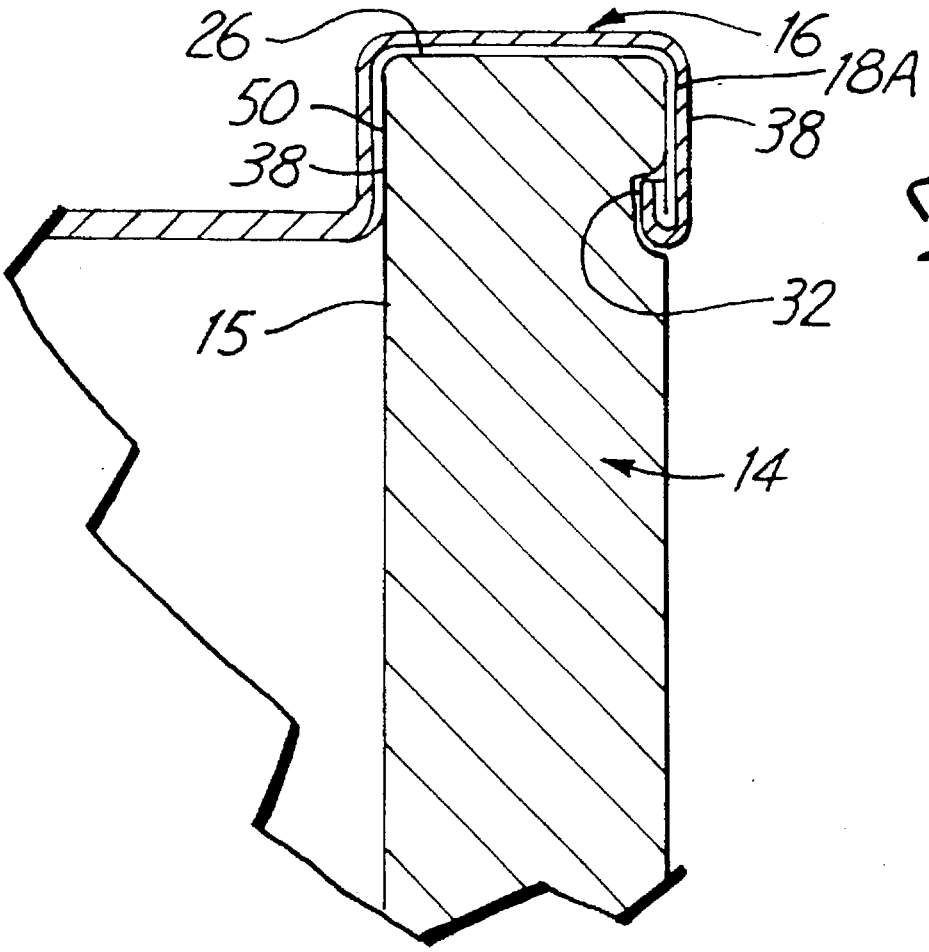
FIG. 9 shows a cross-sectional view of a lid having a channel in a venting position.

The inner surface 40 of the end portion 16 includes channels 18A–H traversing the rim 30, the outer annular shoulder 38, and the inner annular ridge 44, as illustrated in FIG. 1. It is not, however, necessary that the channels of the present invention traverse the inner annular ridge 44. The channels 18A–H permit the venting of headspace gases within the composite can 10 to the outside of the can 10 in a controlled and predictable manner once the end portion 16 is sealed onto the can 10 in response to the expanding leavened dough as shown in FIG. 9. As a consequence, the probability of excessive pressure or spoiled food is significantly decreased.

In particular, the channels 18A–H provide for gas release because when the circular end portion 16 is sealed to the cylindrical portion 14 of the can 10, the outer annular shoulder 38 is positioned to abut the cylindrical portion 14 forming a seal 50, as illustrated in FIG. 3. In forming the seal 50, the outer annular shoulder 38 contacts an inner surface 15 of the cylindrical portion 14. However, the channels 18A–H on the annular shoulder 38 are of a depth and length that permit gases to flow past the seal 50 and then to atmosphere.

In the preferred end portion 16 embodiment illustrated in FIG. 1, several channels 18A–18H are arranged radially around the center 48 of the inner surface 40 of the end portion 16. Each of the several channels traverses the rim 30, the outer annular shoulder 38 and the inner annular ridge 44. The channels 18A–H have dimensions that vent gases quickly while substantially preventing the flow of liquids through the channels.

While several channels are preferred, it is understood, that the end portion 16 of the present invention may include a single channel that traverses the rim 30, the outer annular shoulder 38 and the inner annular ridge 44 of the end portion 16. Preferably, the single channel would have dimensions effective to permit an optimal flowrate of gases to vent from the can while substantially preventing a flow of liquid through the channel.

In one embodiment, the optimal flowrate of gases from a single vent falls within a range of about 1 to 3 milliters per minute, when measured with 4 psig internal pressure. Within this range, a flowrate of about 2 milliters per minute is preferred. An acceptable flowrate would not exceed about 10 milliters per minute. The flowrate is measurable in a can testing device such as is described in a co-pending patent application entitled "Can Vent Testing Device" filed on even date herewith and assigned to the same Assignee which is herein incorporated by reference. The flowrate may also be measured by other methods and devices known in the art. In one embodiment, a depth of the channels is about one micrometer.

For the preferred multiple channel 18A–H embodiment, the flowrate of gas of each of the channels 18A–H preferably falls within a range that is about the same as the flowrate of the single channel of one embodiment as described above.

Figure 4:
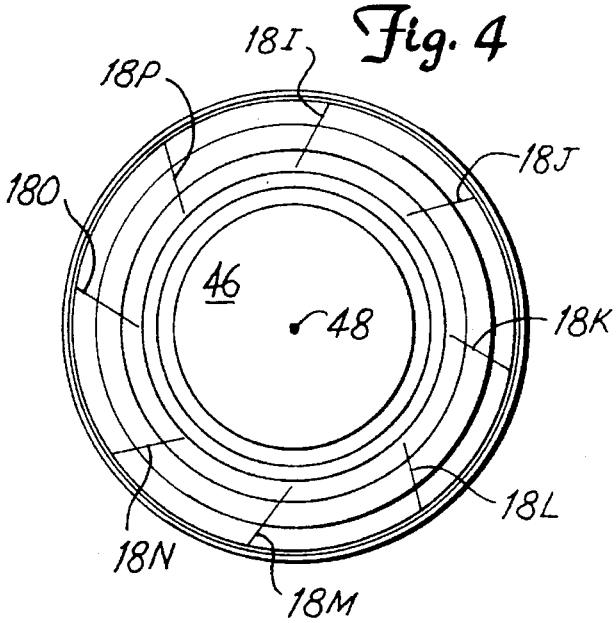
FIG. 4 shows a plan view of an inner surface of the lid having channels of one other embodiment of the present invention.
Figure 5:
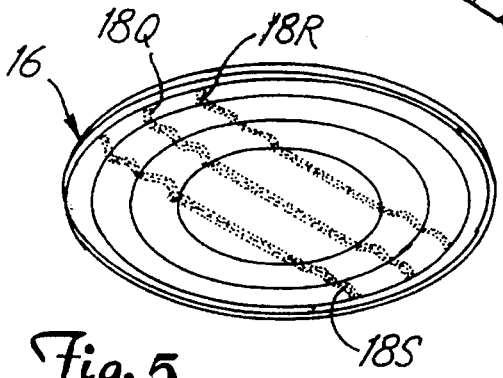
FIG. 5 shows a perspective view of the inner surface of the lid having channels of one further embodiment of the present invention.

In the multiple channel 18A–H embodiment illustrated in FIG. 2, the channels 18A–H extend radially from the center 48 of the end portion 16 and are spaced at a substantially equal distance from each other. In another multiple channel embodiment, illustrated in FIG. 4, the channels 18I–P are offset with respect to the center 48. The offset channels 18I–P traverse the rim 30, the outer annular shoulder 38, and the inner annular ridge 44, in a manner similar to the channels 18A–H of FIG. 2. In one other embodiment illustrated in FIG. 5, the channels 18Q, R, and S extend as chords of the circular end portion 16, traversing the end portion 16. The channels 18Q,R and S of this embodiment are substantially parallel to each other.

Figure 6:
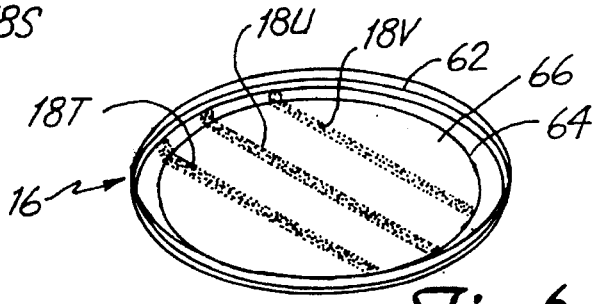
FIG. 6 shows a perspective view of an inner surface of one other lid embodiment having channels of the present invention.

For one other embodiment illustrated in FIG. 6, the circular end portion 16 includes an outer annular lip 62 integral to an annular rim 64. The annular rim 64 conjoins an annular shoulder 66. Channels 18T,U and V may be sized and arranged to traverse the annular rim 64 and shoulder 66 as shown in FIG. 6 or in any of the embodiments described above.

In one embodiment, the channels 18A–V are cut into the inner surface 40 of the end portion 16. Preferably, the channels 18A–V are impressed into the inner surface 40. In one other acceptable embodiment, the channels 18A–V are scratched into the inner surface 40. In another embodiment, the channels 18A–V are made by forming creases into the inner surface 40 of the end portion 16. Whether made by scratching or by creasing, the channels 18A–V traverse the lip 32, the rim 30, the outer annular shoulder 38 and the inner annular ridge 44 of the inner surface 40. Each of the channels 18A–V are made prior to the end portion 16 being sealed to the can 10.

Figure 7:
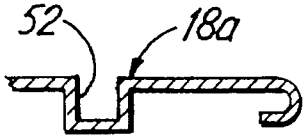
FIG. 7 shows a cross sectional view of one embodiment of a channel having a rectangular shape.
Figure 8:
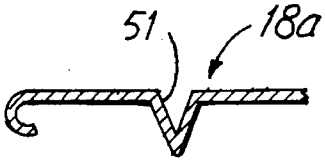
FIG. 8 shows a cross sectional view of one embodiment of a notched channel.

Preferably, the channels 18A–V are sharply defined. In one embodiment, the channel 18A includes a notch 51, such as is illustrated in FIG. 8. In another embodiment, the channel 18A is rectangular, such as is illustrated at 52 in FIG. 7.

The can 10 also includes a second circular end portion 28 that is substantially identical to the circular end portion 16. The second circular end portion 28 is positioned on an opposite end of the can 10 from the end portion 16. In one embodiment that is not shown, the second circular end 28 also includes channels. Each of the end portions 16 and 28 are substantially secured by the clench seal to the cylindrical portion 14 for transport and storage of edible material contained within the can 12, as illustrated in FIG. 3.

In one preferred embodiment, the cylindrical portion 14 is made of materials different from the circular end portion 16. The cylindrical portion 14 of the can 10 includes an outer label layer 21 that overlays a middle fibrous layer 23. The middle fibrous layer 23 stiffens the can 10. The middle fibrous layer 23 is overlayed by the inner liner surface 15. The inner liner surface 15 of the cylindrical portion 14 contacts food stored in the container 10.

In one embodiment, the cylindrical portion 14 includes a spiral seam 22 passing through the outer paper layer 21 and the middle layer 23, illustrated in FIG. 1. The spiral seam 22 is opened by a user to access the food product stored in the composite can. It is not required that the can 10 of the present invention include a spiral seam, however. Other conventional mechanisms for opening a can would be suitable for use in the present invention.

The inner heat seal 15 includes a spiral heat seal joint 60. The heat seal joint 60 on the inner liner layer 15 meets the edge 26 of the cylindrical portion 14. The heat seal joint 60 may also leak gases.

Although the present invention has been described with reference to preferred embodiments, workers skilled in the art will recognize that changes may be made in form and detail without departing from the spirit and scope of the invention.

What is claimed is:

1. A gas pressurizable can for an expanding dough product comprising:

a cylindrical portion with an exterior surface and a shoulder; and a circular end portion, said circular end portion terminating in an annular precurled lip rolled back on itself to secure the precurled lip to the exterior surface of the cylindrical portion wherein the circular end portion overlays the shoulder of the cylindrical portion;

the circular end portion further including an annular recessed rim adjacent the lip and an annular shoulder adjacent the rim; the circular end portion having a channel extending across the rim and the shoulder of the cylindrical portion effective for releasing gas from the can while substantially preventing the release of liquids from the can when the end portion is annularly secured to the exterior surface of the cylindrical portion.

2. The can of claim 1 wherein the channel releases gas at a controlled and predictable rate from the can and at a rate not exceeding about 10 milliliters per minute for one channel.

3. The can of claim 1 wherein the channel is notched.

4. The can of claim 1 wherein the end portion includes a plurality of channels.

5. The can of claim 4 wherein the channels release gas at a rate not exceeding about 10 milliters per minute per channel.

* * * * *

UNITED STATES PATENT AND TRADEMARK OFFICE

CERTIFICATE OF CORRECTION

PATENT NO. : 5,562,230

DATED : Oct. 8, 1996

INVENTOR(S) : Michael R. Perry

It is certified that error appears in the above-indentified patent and that said Letters Patent is hereby corrected as shown below:

On the title page, Item

[54] Delete the word "Greased" and insert the word --Creased--

Col. 1, Title: delete the word "Greased" and insert the word --Creased--

Col. 1, line 13, after the word "properties", delete the ","

Signed and Sealed this

Twenty-second Day of April, 1997

Bruce Lehman

*Attest:*

BRUCE LEHMAN

*Commissioner of Patents and Trademarks*

*Attesting Officer*